United States Patent [19]

Bauer et al.

[11] Patent Number: 4,844,392

[45] Date of Patent: Jul. 4, 1989

[54] GAS SPRING ADJUSTABLE IN LENGTH FOR VERTICALLY ADJUSTABLE CHAIRS, TABLES AND THE LIKE

[75] Inventors: Hans-Peter Bauer; Hans J. Bauer, both of Altdorf; Adolf Gebhardt, Feucht, all of Fed. Rep. of Germany

[73] Assignee: Fritz Bauer + Söhne oHG, Altdorf, Fed. Rep. of Germany

[21] Appl. No.: 122,193

[22] Filed: Nov. 18, 1987

[30] Foreign Application Priority Data

Nov. 18, 1986 [DE] Fed. Rep. of Germany ... 8630918[U]

[51] Int. Cl.[4] ..... F16M 13/00

[52] U.S. Cl. ..... 248/162.1

[58] Field of Search ..... 248/631, 651, 669, 161, 248/162.1, 404, 157, 188.5, 354.1; 188/300, 313, 315, 322.14; 267/64.12; 297/345, DIG. 3, 355

[56] References Cited

U.S. PATENT DOCUMENTS

| | | | |
|---|---|---|---|
| 3,656,593 | 4/1972 | Bauer . | |
| 3,711,054 | 1/1973 | Bauer . | |
| 3,913,901 | 10/1975 | Molders | 248/631 |
| 4,245,826 | 1/1981 | Wirges | 188/300 |
| 4,318,536 | 3/1982 | Bauer | 267/64.12 |
| 4,325,468 | 4/1982 | Siorek | 188/322.14 |

FOREIGN PATENT DOCUMENTS

| | | | |
|---|---|---|---|
| 1430051 | 10/1968 | Fed. Rep. of Germany | 188/322.14 |
| 1263245 | 11/1968 | Fed. Rep. of Germany . | |
| 1150431 | 1/1958 | France | 188/315 |
| 2506771 | 3/1987 | France | 188/300 |
| 8401605 | 4/1984 | PCT Int'l Appl. | 188/315 |
| 296897 | 9/1928 | United Kingdom . | |
| 981915 | 1/1965 | United Kingdom | 188/322.14 |
| 1550162 | 8/1979 | United Kingdom | 248/161 |

*Primary Examiner*—Ramon O. Ramirez
*Assistant Examiner*—Robert A. Olson
*Attorney, Agent, or Firm*—Browdy and Neimark

[57] ABSTRACT

A gas spring adjustable in length has a housing and a piston rod brought out at one end. Disposed at the opposite end is a valve by means of which movements of longitudinal adjustment of the piston rod relative to a housing filled with a pressure medium are released or stopped. These gas springs are principally used for the vertical adjustment of chairs or tables. In order to make said vertical adjustment more comfortable, a damper valve is disposed in the valve effecting in different manner in each instance the throttling on the insertion of the piston rod into the housing or on the extraction of said piston rod out of the housing.

14 Claims, 4 Drawing Sheets

GAS SPRING ADJUSTABLE IN LENGTH FOR VERTICALLY ADJUSTABLE CHAIRS, TABLES AND THE LIKE

FIELD OF THE INVENTION

The invention relates to a gas spring adjustable in length for vertically adjustable chairs, tables or the like with a housing filled at least partly with a pressurised medium able to flow and having at least one cylinder, with a piston slidably mounted in the cylinder and applying on the inner wall thereof via a seal and separating the inner space of this cylinder into two housing spaces, said piston being connected with a closed piston rod outwardly guided and sealed towards one end of the housing, with a valve, disposed in a flow path for the pressure medium between the housing spaces for connecting and/or separating the two housing spaces which is disposed at the end of the housing opposite the end where the piston rod is outwardly guided and with arrangements for throttling the pressure medium in its flow path between the two housing spaces.

BACKGROUND OF THE INVENTION

Such gas springs adjustable in length are known, for example from U.S. Pat. No. 3,656,593. They are used, inter alia, as a height adjustment member in chair columns for vertically adjustable chairs or corresponding columns for vertically adjustable tables. This is known, for example from U.S. Pat. No. 3,711,054. This adjustment of the height of chairs or seats is effected in that the valve of the gas spring is opened while the user is sitting on the chair. If he causes his entire body weight to act on the seat and thereby on the gas spring, the piston rod together with the piston is pushed into the housing, i.e. the seat lowers. If, on the other hand, he releases the load from the seat, in that he shifts part of his body weight in seated position onto his legs, the piston will be pushed out of the housing, i.e. the seat is raised. While the lowering of the seat thus takes place in an uncramped position of the user, the latter finds himself or herself in a cramped position on raising the seat. If, on the other hand, the gas spring is used as a vertical adjustment member for tables, it will be desirable as a rule to effect the upward movement of the table top, that is to say the driving out of the piston rod, in relatively pronounced cushioned manner, whereas the lowering of the table top, i.e. the pushing in of the piston rod is to be effected in relatively light manner.

From German Pat. No. 12 63 245 a hydro-pneumatic lifting unit for furniture is known, in which simply a damping of the outward movement of the piston rod is to be achieved. A constructional improvement of this lifting unit is known from German published patent application No. 34 19 364. In neither of these cases are the depicted specific problems connected with the use of gas springs adjustable in length in chair columns dealt with.

SUMMARY OF THE INVENTION

The invention has therefore for its object to construct a gas spring of the generic type in such a manner that the height adjustment of a chair or of a table is achieved more comfortably.

This object is achieved according to the invention in that these arrangements are designed to throttle differently on the driving in of the piston rod into the housing and on the driving out of the piston rod from the housing, and are disposed in the valve. As a result of the steps according to the invention an asymmetrical cushioning is therefore achieved. The entirety of the devices for throttling the pressure medium are housed in compact manner in the valve.

When the gas spring according to the invention is provided for a chair or seat, the arrangements for throttling the pressure medium are advantageously designed to throttle in more pronounced manner on the driving of the piston rod into the housing than on the driving out of the piston rod out of the housing. In this case, on the other hand, the inward movement of the piston rod, i.e. the lowering of the chair column is cushioned in stronger manner, and thus proceeds adequately slowly, so that an exact positioning can be effected. On the other hand, the outward movement of the piston rod, and thereby the lifting of a seat, takes place definitely more quickly, so that the user has to adopt only for a very short time the slightly cramped position which releases the load from the seat top.

When arrangements for throttling the pressure medium have at least one damper valve, the asymmetrical damping may be effected in particularly simple manner. Very precisely defined flow conditions may be achieved, when the damper valve closes on driving the piston rod into the housing and opens on driving the piston rod out of the housing. This effect is further improved, when the said arrangements have additionally to the damper valve an overflow channel with throttling part connecting the two housing spaces. In this case precisely damped inward movements of the piston rod and precisely defined very much faster, indeed less cushioned, outward movements of the piston rod are made possible.

Further advantages and features of the invention will become apparent from the ensuing description of an exemplary embodiment taken in conjunction with the drawings.

DESCRIPTION OF A PREFERRED EMBODIMENT

Figure 1:
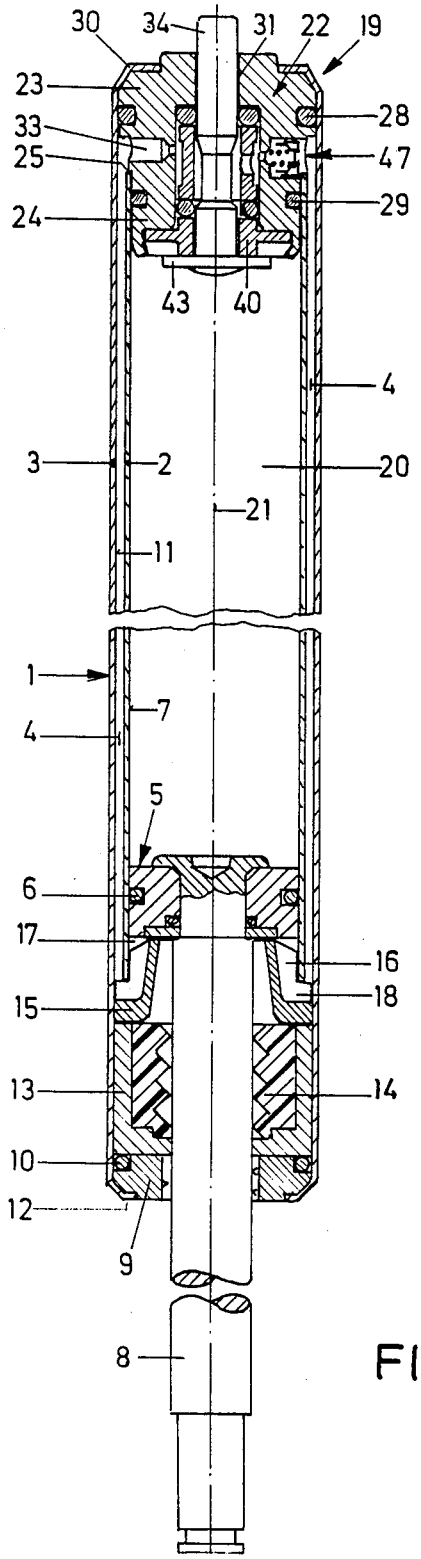
FIG. 1 shows a gas spring adjustable in length according to the invention in longitudinal section.

The gas spring adjustable in length represented in FIG. 1 has a housing 1 which consists substantially of two tubes of different diameter mounted concentrically one inside the other, i.e. an inner cylinder 2 and an outer cylinder 3. Between the outer cylinder 3 and the inner cylinder 2 an annular space 4 is formed as a result of the difference in diameters between inner cylinder 2 and outer cylinder 3.

Disposed in the inner cylinder 2 is a substantially annular piston 5, mounted in axially slidable manner and sealed off in gas tight manner by means of a sealing ring 6 at its outer circumference with respect to the inner wall 7 of the inner cylinder 2. The piston 5 is fixed at one end of a piston rod 8 driven coaxially with the housing 1. This piston rod 8 comes out of one end of the housing 1. At this end the housing 1 is closed by means of a closure disc 9 which, at its outer circumference, is sealed in gas tight manner by means of an annular seal 10 with respect to the inner wall 11 of the outer cylinder 3. The closure disc 9 is held axially outwards by means of a flanging 12 of the outer cylinder 3. A cup-shaped bushing 13 is mounted on the inside applying against the closure disc 9; this bushing 13 receives a multiple lip seal 14 which applies tightly by its lips against the piston rod 8. By this means a leakage of gas outwards along the surface of the piston rod 8 is prevented.

From the inner space of the housing 1 a centering piece 15, applying onto the inner wall 11 of the outer cylinder 3, rests aganst the bushing 13. Said centering pipe 15 is provided with ribs 16 on which the inner cylinder 2 is radially supported, i.e. centered with its inner wall 7. The inner cylinder 2 is also rigidly axially supported, thus axially secured on one side, on said ribs 16. As a result of the fact that only ribs 16 are provided for the centering and axial support of the inner cylinder 2, the annular space 4 is, in this region, connected with the housing space 17 in the inner cylinder 2, said housing space being delimited between the piston 5, the end of the housing 1 where the piston rod 8 is outwardly guided and the inner wall 7 of the inner cylinder 2. Between the ribs 16 overflows channels 18 are thus formed between the housing space 17 and the annular space 4.

At the end of the housing 1 opposite to the exit of the piston rod a valve 19 is disposed by means of which the housing space 20 is disposed in the inner cylinder 2 between the piston 5 and the valve 19 is connected with, or can be separated from, the annular space 4 and therefore the outer housing space 17.

The entire gas spring together with the valve 19 is constructed substantially symmetrically with the centre longitudinal aixs 21. The valve 19 has a valve body 22 which is formed of an outer section 23 and an inner section 24. The outer section 23 applies against the inner wall 11 of the outer cylinder 3, as a result of which the valve body 22 is centered relative to the outer cylinder 3. The section 24, also cylindrical but with a smaller diameter, applies against the inner wall 7 of the inner cylinder 2, as a result of which a centering is effected between the valve body 22 and the inner cylinder 2 and therefore also between the inner cylinder 2 and the outer cylinder 3. In the transitional region from section 23 to section 24 an abutment shoulder 25 is formed, by means of which the valve body 22 applies in axial direction against the inner cylinder 2. In the region of section 23 on the one hand and section 24 on the other hand, in corresponding annular grooves 26, 27, annular seals 28, 29 are disposed, by means of which there is obtained respectively a gas-tight connection between outer portion 23 and the inner wall 11 of the outer cylinder on the one hand, and between the inner portion 24 and the inner wall 7 of the inner cylinder 2 on the other hand. The valve body is axially held outwards by a bead 30 of the outer cylinder 3, as a result of which, again, the inner cylinder 2 is also secured outwards.

The valve body 22 is provided in the region of its outer portion 23 with a cylindrical, coaxial guide cavity 31 onto which there connects, in the direction towards the housing space 20, a valve body inner space 32 still substantially situated in the outer portion 23. This inner space 32 has a diameter greater than that of the guide cavity 31. In this inner space 32 there opens out an overflow channel 33 passing through the valve body radially and which, on its outer side, opens out into the annular space 4.

Disposed in the valve body 22 is a valve pin 34 which protrudes outwards out of the valve body 22 and therefore out of the gas spring. This substantially cylindrical valve pin 34 is guided in the guide cavity 31. At the transition from the guide cavity 31 to the inner space 32 an inner annular seal 35 is disposed which is secured axially outwards by the transition between inner space 32 to the guide cavity 31, and which lies radially on the valve pin 34 and on the wall of the inner space 32 so that an outflow of the gas through the guide cavity 31 is ruled out. The inner annular seal 35 is axially secured in the direction towards the housing space 20 by a spacer bushing 36 which is provided with one or more passage openings 37 so that gas can also enter the spacer bushing 36.

At the end of the spacer bushing 36 facing the housing space 20 there is also an inner annular seal 38 which applies radially against the inner wall of the inner space 32 and against the valve pin 34. Axially to the housing space 20 it applies against a locating face 39.

This locating face 39 is formed on a bushing-shaped shut-off part 40 which surrounds the valve pin 34 forming an annular gap 41. A radially outwardly protruding annular collar 42 of this shut-off part 40 is axially secured in the inner portion 24 of the valve body 22. The valve pin 34 is secured outwardly by means of a holder plate 43 against an outward pushing out of the valve body 22.

This holder plate 43 lies—when the valve 19 is closed—against an abutment surface 44 of the shut-off part 40 facing the housing space 20. In the rest position of the valve pin 34 represented in FIGS. 1 and 2, in which position the valve 19 is closed, there is a restriction 45 of the valve pin 34 between the inner annular seals 35 and 38, i.e. the housing space 20 is separated in gas tight manner from the annular space 4 and also from the housing space 17. As a result of the pushing of the valve pin 34 into the valve body 22 the restriction 45 bridges over the inner annular seal 38 facing the housing space 20, so that the gas from the housing space 17 can flow through the annular space 4, the channel 33, the valve body inner space 32 and the annular gap 41 into the housing space 20 and back. The opposite modus operandi of this gas spring adjustable in length, filled at least partly with gas, is moreover generally known, e.g. from U.S. Pat. No. 3,656,593.

Figure 2:
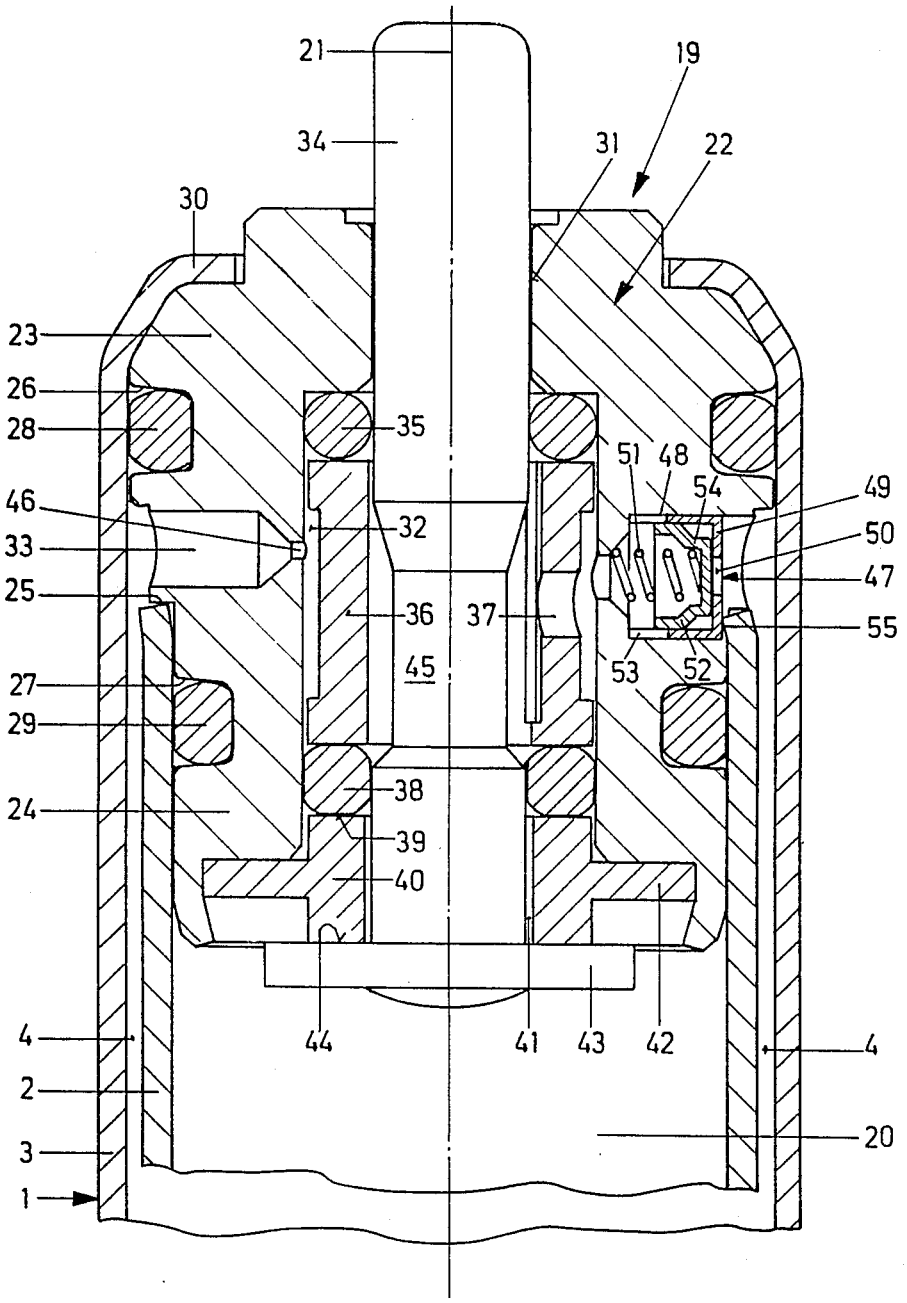
FIG. 2 shows an enlarged representation of the valve of the gas spring according to FIG. 1.

As may be seen from FIG. 2 the overflow channel 33 has a throttling part 46 of extremely small cross-section. The diameter of such a throttling part 46 is smaller than 1.0 mm and preferably in the range of 0.4 to 0.7 mm. If only this overflow channel 33 with such a throttling part 46 is available then the ingoing and outgoing movement of the piston rod 8 takes place extremely slowly when the valve 19 is open.

In the valve body 22, and indeed in the outer portion 23, a damper valve 47 is disposed which opens when the gas flows through the valve 19 and which closes at least very substantially when the gas flows in the opposite direction. Said damper valve is disposed in a connection channel 48 between the annular space 4 and the valve body inner space 32. In the concrete method of embodiment according to FIG. 2 a cup-shaped valve seat 49 is disposed in the connection channel 48 and has a valve opening 50 facing the annular space 4. A valve piston 52 loaded with a valve spring 51 is guided in the valve seat 49. The valve spring 51 pushes the valve piston 52 in front of the valve opening 50 to bias the valve to a closed position. Said spring is supported in the valve body 22. The cup-shaped valve seat 49 has passage slits 53 in its region facing away from the valve opening 50 and therefore facing the inner space 32. The valve piston 52 is provided with a narrowing 54 in the vicinity of the valve opening 50. The embodiment described hereinabove leads to the fact that in the position of the valve piston 52 shown in the drawing the valve opening 50 and thereby the damper valve 47 is closed tightly. If, on the other hand, the valve piston 52 is lifted off the valve opening 50 against the pressure of the valve spring 51, the narrowing 54 comes to overlay the passage slits 53 so that gas is able to flow out of the annular space 4 through the valve opening 50, the region of the narrowing 54, the passage slits 53 into the inner space 32. The unit, consisting of valve spring 51, valve piston 52 and cup-shaped valve seat 49, is held in the connection channel 48 by the adjoining edge 55 of the inner cylinder 2 which otherwise lies against the abutment shoulder 25.

If, when the valve 19 is open, the piston rod 8 with the piston 5 is pushed in, in the direction of the valve 19 into the housing 1, there is produced an additional gas pressure from the valve body inner space 32 onto the valve piston 52, as a consequence of which the damper valve 47 remains tightly closed; therefore gas can only flow through the strongly throttling overflow channel 33 and from there through the annular space 4 into the other housing space 17. If, conversely, when the valve 19 is open the piston rod 18 is pushed out of the housing 1, then a pressure is exerted onto the valve piston 52 from the valve opening 50 against the tension of the valve spring 51 so that the damper valve 47 opens. In this case, therefore, gas is able to flow through the damper valve 47. It is thus possible for a greater amount of gas to flow per time unit through the damper valve 47 and the throttling part 46 than would be the case with the reverse direction of flow, when the gas can flow only through the throttling part 46. If—as is generally the case and is known from U.S. Pat. No. 3,711,054—the gas spring is constructed in a vertically adjustable chair column of a vertically adjustable chair or seat in such a manner that the valve pin 34 is situated at the top below the chair seat, then it becomes possible to effect the lowering of a seat in relatively pronounced cushioned manner, and thus slowly, and the lifting or raising of the seat can take place relatively quickly.

Figure 3:
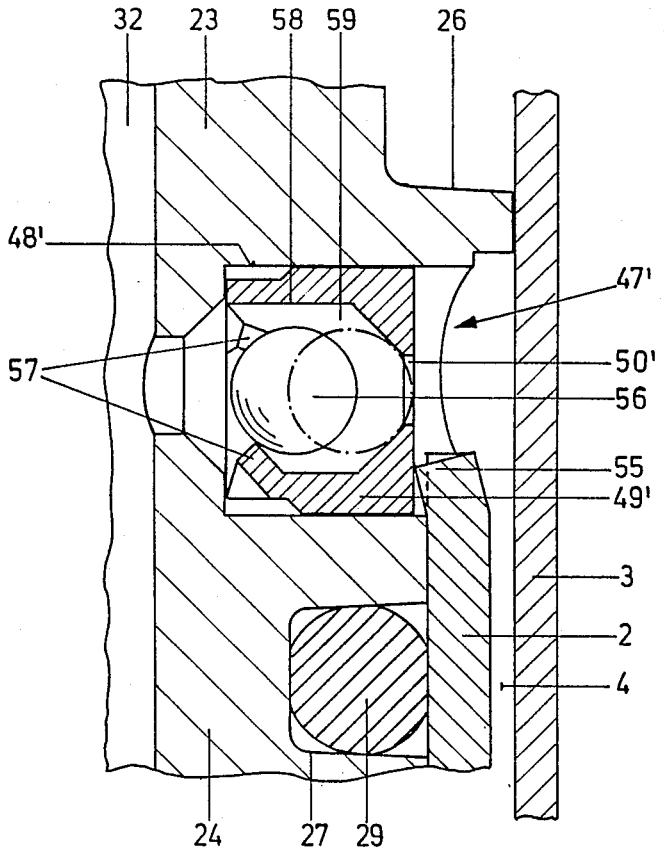
FIG. 3 shows a partial section through the valve of the gas spring adjustable in length with a modified form of construction of a damping valve.

FIG. 3 shows a modified method of embodiment of a damper valve 47' which in this case is constructed as a flap valve loaded with a valve spring. It has also a cup-shaped valve seat 49' situated in a connection channel 48' between the annular space 4 and the inner space 32 of the valve body which valve space 49' has a valve opening 50' facing the annular space 4. Provision is made as valve piston for a ball 56 which sits in an end position—shown in broken lines—in front of the valve opening 50' and closes same. In its other end position, facing the valve body inner space 32, represented pulled out, it applies against inwardly bent projections 57 of the cup-shaped valve seat 49'. Between the ball 56 and the inner wall 58 of the valve seat 49' a throughflow channel 59 is formed which is open to the valve body inner space 32. The projections 57 protrude into this throughflow channel 59, but do not close it off.

If, when valve 19 is open, the piston 5 with piston rod 8 move out of the housing 1, the ball 56 is then lifted by the gas spring coming from the valve opening 50' via the annular space and is held up by the projections 57. The gas stream can flow on through the throughflow channel 59 into the inner space 32 and from there in the manner represented. If, on the other hand, the piston rod 8 with the piston 5 is pushed into the housing 1, then the gas stream coming from the valve body inner space 32 pushes the ball 56 against the valve opening 50' and thus closes the damper valve 47'. When the valve 19 is closed the ball 56 has no definite position relative to the valve seat 49'; it is thus a flap valve. With this construction also of the damper valve 47' the overflow channel 33 is available with the throttling part 46.

However, the damper valve may also be so constructed that it opens for both directions of gas flow, in connection with which, however, correspondingly different throughflow cross-sections are supplied so that also an asymmetrical damping, as was described hereinabove, is achieved. In this case the overflow channel 33 with the throttling part 46 would not be necessary.

If hereinabove gas or pressurised gas was mentioned this can be also a fluid pressurized by a compression gas if, in fact, the gas spring is in known manner partly filled with fluid and only partly with a compressed gas pressurising said fluid.

In addition it will be also mentioned that it already follows from the above description that the overflow channel 33 with the throttling part 46 on the one hand and the damper valve 47 or 47' on the other hand are mounted in parallel with each other.

Figure 4:
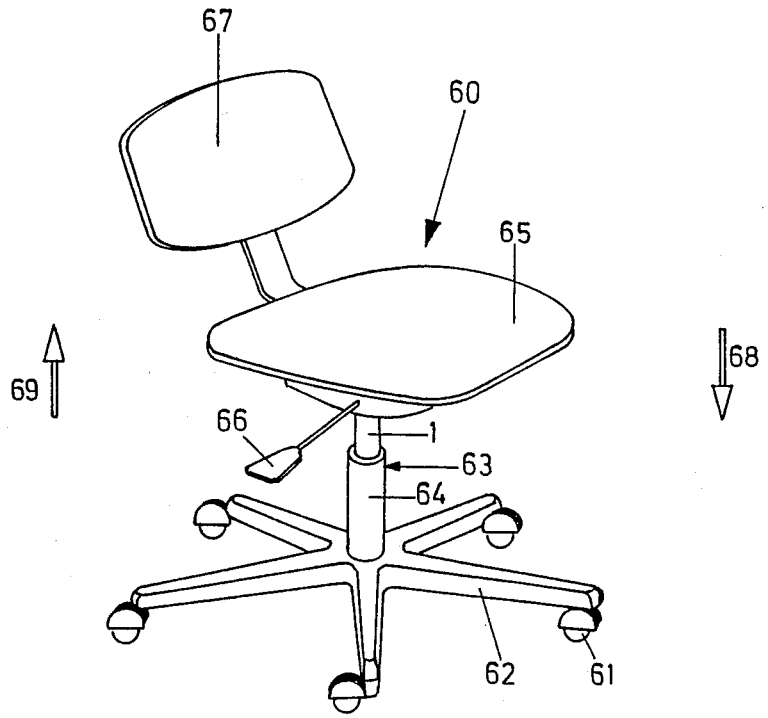
FIG. 4 shows a chair which is vertically adjustable by means of a gas spring according to the invention.

FIG. 4 shows the utilisation of the gas spring represented, the construction thereof being incorporated in per se known manner, e.g. in an office chair. The latter has a chair cross support supported on the ground on wheels 61, on which a chair column 63 is disposed protruding upwards. The latter has a guide tube 64 in which the above-described gas spring is mounted in such a manner that its piston rod 8 is fixed on the bottom of the guide tube 64, while the housing 1 is passed slidably in the guide tube 64. The upper end of the housing 1, from which the valve pin 34 protrudes, is fixed onto the underside of a seat 65, a swivellable actuation lever 66 being provided for the operation of the valve pin 34. The chair has furthermore in usual manner a back 67. If the seat 65 is moved downwards in accordance with the direction of the arrow 68, this movement is considerably damped, as the damper valve 47 or 47' is closed. If, on the other hand, the seat is moved upwards correspondingly to the direction of the arrow 69, this movement is considerably less damped, as the damper valve 47 or 47' is open.

An arrangement of a damper valve in the region of the exiting of the piston rod 8 out of the housing 1, e.g. therefore in the overflow channel 18, would be disadvantageous as this would lead to jolting or shaking movements of the gas spring when adjustments in length are made, i.e. on the pushing in or bringing the piston rod 8 out of the housing 1. The reasons for this lie in the fact that the gas spring under consideration, in particular in vertical position with downwardly protruding piston rod, is used in vertically adjustable chair columns or the like. It has a small amount of oil for lubrication and seal improvement purposes, which oil, on the basis of the incorporated position represented, is situated in front of the seal 14 in the vicinity of the centering piece 15, and particularly in front of the overflow channels 18. This amount of oil would then always have to be pressed by the corresponding damper valve which, then, would have not only gas, but also in this case, from time to time, oil passing through it.

What is claimed is:

1. A gas spring adjustable in length for vertically adjustable chairs, tables or the like with a housing (1) filled at least partly with a gas under pressure able to flow and having at least one cylinder, with a piston (5) slidably mounted in the cylinder and applying on the inner wall (7) thereof via a seal (6) and separating the inner space of this cylinder into two housing spaces (17,20), said piston (5) being connecting with a closed piston rod (8) outwardly guided and sealed towards one end of the housing (1), with a valve (19) disposed in a flow path for the gas under pressure between the housing spaces (17, 20) for connecting and/or separating the two housing spaces (17, 20) which is disposed at the end of the housing (1) opposite the end where the piston rod (8) is outwardly guided, said valve (19) including a valve pin (34) having an end extending outside said housing (1) for opening said valve (19), and with arrangements for throttling the gas in its flow path between the two housing spaces (17, 20), wherein these arrangements are designed to throttle differently on the driving in of the piston rod (8) into the housing (1) and on the driving out of the piston rod (8) from the housing (1), and are disposed in the valve (19).

2. A gas spring according to claim 1 for vertically adjustable chairs, wherein the arrangements for throttling the gas under pressure are designed to throttle in more pronounced manner on the driving of the piston rod (8) into the housing (1) than on the driving out of the piston rod (8) out of the housing (1).

3. A gas spring according to claim 1, wherein the said arrangements have at least one damper valve (47, 47').

4. A gas spring according to claim 3, wherein the housing (1) substantially consists of an inner cylinder (2) and an outer cylinder (3), an annular space (4) being formed between said cylinders (17, 20) and the piston (5) being slidably mounted in said inner cylinder (2) and wherein the damper valve (47, 47') is disposed in a connection channel (48, 48') in the valve (19) and is held in the direction towards the annular space (4) by an adjoining edge (55) of the inner cylinder (2).

5. A gas spring according to claim 3 wherein said valve (19) comprises a valve body (22) within which said valve pin (34) is adapted to slide, said valve body (22) having a connection channel (48) extending therethrough to an outer surface of said valve body, said damper valve (47, 47') being disposed as a unit in said connection channel (48).

6. A gas spring according to claim 3 wherein said damping valve (47, 47') comprises a cup-shaped valve seat (49, 49') and a valve element (52, 56) movable in said cup-shaped valve seat (49, 49') between an open position and a closed position.

7. A gas spring according to claim 6 wherein said damping valve (47, 47') further comprises a valve spring (51) biasing said valve element (52) to a closed position.

8. A gas spring according to claim 3, wherein the damper valve (47, 47') closes on driving the piston rod (8) into the housing (1) and opens on driving the piston rod (8) out of the housing (1).

9. A gas spring according to claim 8, wherein the damper valve (47, 47') is constructed as a check-valve.

10. A gas spring according to claim 8, wherein the damper valve (47') is constructed as a flap valve.

11. A gas spring according to claim 8, wherein the damper valve (47) is provided with a spring-loaded valve piston (52).

12. A gas spring according to claim 8, wherein the said arrangements have additionally to the damper valve (47, 47') an overflow channel (33) with throttling part (46) connecting the two housing spaces (17, 20).

13. A gas spring according to claim 12 wherein said throttling part (46) has the same operation with regard to ingoing and outgoing movement of said piston rod (8), and said throttling part (46) is disposed parallel to said damper valve (47, 47').

14. A length-adjustable gas spring for vertically adjustable chairs, tables or the likes, comprising:

an outer housing and a concentrically mounted inner cylinder, said housing and said cylinder defining an annular space therebetween and first and second ends, and said housing and cylinder containing a gas under pressure;

a piston slidably and sealingly mounted in said cylinder and separating said cylinder into a first chamber of variable capacity downstream of said piston and a second chamber of variable capacity upstream of said cylinder, said piston being imperforate so as to prevent passage of gas through said piston between said first and second chambers, said annular space and said second chamber being in communication in the vicinity of said second end;

a piston rod connected to said piston and extending through said second chamber and out through said second end;

a valve and valve body disposed at said first end, said valve including a valve pin having an end extending outside said housing for opening said valve so as to permit communication between said annular space and said first chamber;

throttling means extending through said valve body for restricting the flow of gas under pressure through said valve and between said annular space and said first chamber; and a second gas passageway through said valve body in parallel with said throttling means, and a damper valve disposed in said second passageway, said damper valve being closed when said piston moves downstream toward said first end to make said first chamber smaller, and said damper valve being open when said piston moves upstream away from said first end to make said first chamber larger;

said throttling means and said damper valve together constituting means for insuring a rapid flow of gas through said valve when said valve is open and said piston is moving upstream to enlarge said first chamber, and a slow flow of gas through said valve when said valve is open and said piston is moving downstream to reduce the size of said first chamber.

* * * * *